US010941524B2

(12) United States Patent
Barton et al.

(10) Patent No.: US 10,941,524 B2
(45) Date of Patent: Mar. 9, 2021

(54) PULP MIXTURE

(71) Applicant: SOLENIS TECHNOLOGIES, L.P., Wilmington, DE (US)

(72) Inventors: Iris Bennor Barton, Hockessin, DE (US); Todd Bolton, Hockessin, DE (US); Daniel Joseph Nicholson, Swarthmore, PA (US); Scott Thomas Schnelle, West Grove, PA (US)

(73) Assignee: SOLENIS TECHNOLOGIES, L.P., Wilmington, DE (US)

( * ) Notice: Subject to any disclaimer, the term of this patent is extended or adjusted under 35 U.S.C. 154(b) by 69 days.

(21) Appl. No.: 16/205,798

(22) Filed: Nov. 30, 2018

(65) Prior Publication Data

US 2020/0173111 A1 Jun. 4, 2020

(51) Int. Cl.
*D21H 21/10* (2006.01)
*D21H 17/53* (2006.01)
*D21H 17/37* (2006.01)

(52) U.S. Cl.
CPC ..... *D21H 21/10* (2013.01); *D21H 17/37* (2013.01); *D21H 17/53* (2013.01)

(58) Field of Classification Search
None
See application file for complete search history.

(56) References Cited

U.S. PATENT DOCUMENTS

| | | | | |
|---|---|---|---|---|
| 3,355,400 | A | 11/1967 | Smith et al. | |
| 3,944,594 | A | 3/1976 | Kleiner et al. | |
| 6,228,217 | B1 | 5/2001 | Dickerson et al. | |
| 2015/0041090 | A1 | 2/2015 | Harrington et al. | |
| 2015/0129148 | A1* | 5/2015 | Barton | D21H 21/10 162/164.2 |
| 2015/0166836 | A1* | 6/2015 | Liu | C09D 197/005 427/331 |
| 2017/0009100 | A1 | 1/2017 | Ling et al. | |

OTHER PUBLICATIONS

ISA/US, International Search Report and Written Opinion issued in Int. Appl. No. PCT/US2019/062726, dated Mar. 3, 2020.

* cited by examiner

*Primary Examiner* — Dennis R Cordray
(74) *Attorney, Agent, or Firm* — Lorenz & Kopf, LLP

(57) ABSTRACT

A pulp mixture includes a lignocellulosic material, water, lignin, an inorganic salt, and a copolymer including two or more structural units chosen from ethylene oxide units, propylene oxide units, (meth)acrylic acid units, ethyl acrylate units, and combinations thereof. The copolymer is free of silicone-containing structural units and the lignin is present in an amount of greater than about 150 ppm, based on a total weight of the pulp mixture.

20 Claims, 6 Drawing Sheets

| Volume, mL | Blank | Copolymer 9 | Copolymer 10 | Copolymer 11 |
|---|---|---|---|---|
| 0 | 0 | 0 | 0 | 0 |
| 50 | 2.06 | 2.26 | 1.87 | 2.34 |
| 75 | 4.12 | 3.51 | 3.22 | 3.84 |
| 100 | 6.24 | 5.14 | 4.77 | 5.27 |
| 125 | 8.69 | 6.83 | 6.49 | 7.02 |
| 175 | 15.24 | 10.46 | 10.21 | 10.77 |
| 200 | 19.14 | 13.28 | 12.28 | 12.95 |
| 225 | 23.28 | 15.39 | 14.31 | 15.27 |
| 250 | 27.32 | 17.4 | 16.36 | 17.34 |
| 275 | 31.94 | 19.36 | 18.29 | 19.4 |
| 300 | 37.08 | 21.66 | 20.36 | 21.86 |
| 325 | 42.36 | 24.02 | 22.74 | 24.14 |
| 350 | 47.66 | 26.5 | 24.9 | 26.7 |
| 375 | 53.16 | 28.72 | 27.2 | 29.14 |
| 400 | 59.21 | 31.22 | 29.7 | 31.84 |
| 425 | 65.49 | 33.88 | 32.18 | 34.57 |

PULP MIXTURE

TECHNICAL FIELD

The present disclosure generally relates to a pulp mixture that typically exhibits improved drainage during pulp washing. More specifically, this disclosure relates to a pulp mixture that includes a particular copolymer that is free of silicone-containing structural units.

BACKGROUND

Washing at various points in the pulp production process can be a bottleneck. Increasing the rate of washing can mitigate this bottleneck. Alternatively, production rates can be held constant while the pulp can be washed more completely. This alternative method conserves chemicals that are typically recovered in the wash effluent and also may result in a chemical savings in the following stages from treating cleaner pulp.

Washing efficiency is especially important before and during bleaching of the pulp. Increasing washing efficiency conserves bleaching chemicals which are one of the largest costs in a pulp mill. Some of the effluent from treating the pulp, e.g. after the pulp has been contacted with chlorine containing chemicals, must also be treated by an onsite wastewater treatment plant before release. Minimizing water and chemical use during bleaching is an important industry need.

Typically, the chemical treatment of pulp both during and between bleaching stages is restricted as to the type of products that can be used due to pulp quality concerns. This is especially important for specialty pulps that are highly regulated or require particular cleanliness levels. Examples of such specialty pulps include fluff pulp, pulp for cellulose derivative manufacture, and dissolving pulp. However, even large market pulp producers limit the type of products that can be used. For example, many produces restrict the use of silicone based defoamers and drainage enhancement compounds.

Accordingly, there remains an opportunity to develop compounds that can be used in pulp production that perform the similarly to, or better than, existing silicone based products. Furthermore, other desirable features and characteristics of the present disclosure will become apparent from the subsequent detailed description of the disclosure and the appended claims, taken in conjunction with the accompanying drawings and this background of the disclosure.

BRIEF SUMMARY

This disclosure provides a pulp mixture including a lignocellulosic material, water, lignin, an inorganic salt, and a copolymer including two or more structural units chosen from ethylene oxide units, propylene oxide units, (meth) acrylic acid units, ethyl acrylate units, and combinations thereof. The copolymer is free of silicone-containing structural units and the lignin is present in an amount of greater than about 150 ppm, based on a total weight of the pulp mixture.

This disclosure also provides a method for improving drainage during pulp washing. The method includes providing the aforementioned pulp mixture, forming a pulp mat from the pulp mixture, and draining the water from the pulp mat. In this embodiment, the pulp mixture exhibits an increase of at least about 5% in drainage rate of the water from the pulp mat in the presence of the copolymer as compared to the drainage rate of water from a pulp mat in the absence of the copolymer.

BRIEF DESCRIPTION OF THE DRAWINGS

The present disclosure will hereinafter be described in conjunction with the following drawing figures, wherein.

DETAILED DESCRIPTION

Figure 1:
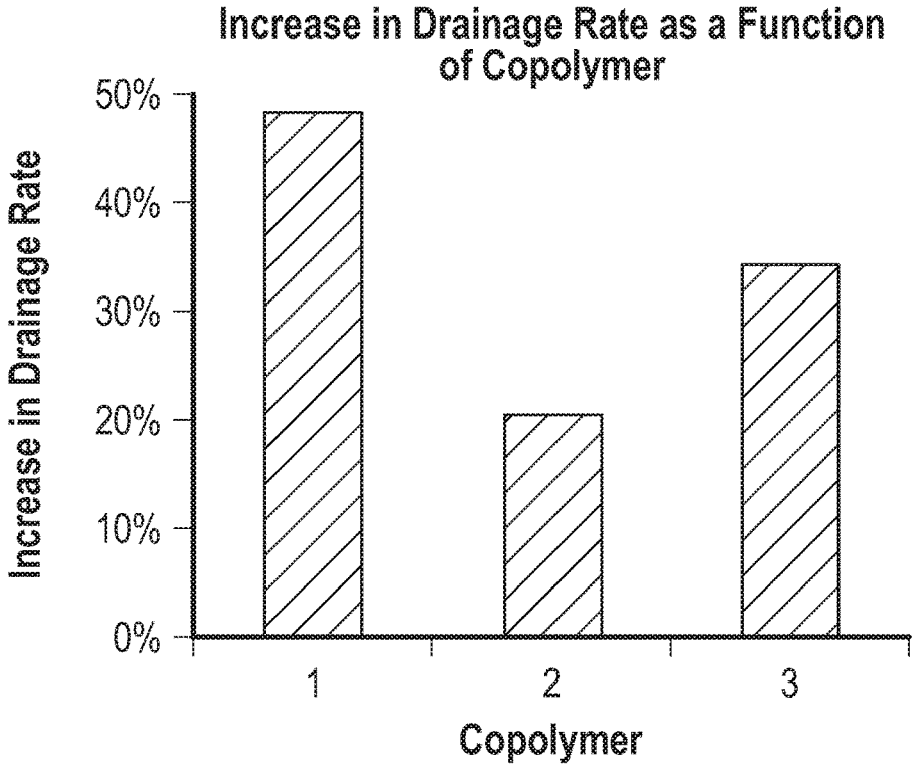
FIG. 1 is a bar graph of increase in drainage rate as a function of choice of copolymer, as described in Example 1.

The following detailed description is merely exemplary in nature and is not intended to limit the pulp mixture or method of this disclosure. Furthermore, there is no intention to be bound by any theory presented in the preceding background or the following detailed description.

Embodiments of the present disclosure are generally directed to pulp mixtures and methods for forming and utilizing the same. For the sake of brevity, conventional techniques related to pulp mixtures may not be described in detail herein. Moreover, the various tasks and process steps described herein may be incorporated into a more comprehensive procedure or process having additional steps or functionality not described in detail herein. In particular, various steps in the formation of pulp mixtures are well-known and so, in the interest of brevity, many conventional steps will only be mentioned briefly herein or will be omitted entirely without providing the well-known process details.

This disclosure provides a pulp mixture. The pulp mixture includes a lignocellulosic material, water, lignin, an inorganic salt, and a copolymer including two or more structural units chosen from ethylene oxide units, propylene oxide units, (meth)acrylic acid units, ethyl acrylate units, and combinations thereof. In various embodiments, the pulp mixture consists essentially of the lignocellulosic material, water, lignin, an inorganic salt, and the copolymer. The pulp mixture may be free of any one or more additional polymers including, but not limited to, silicone polymers.

In various embodiments, the pulp mixture exhibits an increase in drainage rate of the water in the presence of the copolymer as compared to a pulp mixture that is drained in the absence of the copolymer. For example, the pulp mixture may exhibit an increase of at least about 5%, about 10%, about 15%, about 20%, about 25%, about 30%, about 35%, about 40%, about 45%, about 50%, about 55%, about 60%, about 65%, about 70%, about 75%, etc. in drainage rate of water from a pulp mat in the presence of the copolymer as compared to the drainage rate of water from a pulp mat in the absence of the copolymer. These rates may fluctuate, for example, when measured relative to brownstock drainage or bleached pulp extraction stage drainage.

In other embodiments, the pulp mixture exhibits an increase of at least about 5%, about 10%, about 15%, about 20%, about 25%, about 30%, about 35%, about 40%, about 45%, about 50%, about 55%, about 60%, about 65%, about 70%, about 75%, etc. in dewatering rate as defined as an amount of water passing through a pulp mat in the presence of the copolymer per unit washing time as compared to an amount of water passing through a pulp mat in the absence of the copolymer per unit washing time.

In further embodiments, the pulp mixture that includes the inorganic salt exhibits a decrease in an amount of the inorganic salt of at least about 5%, about 10%, about 15%, about 20%, about 25%, about 30%, about 35%, about 40%, about 45%, etc. based on mass balance calculations and as measured by total dissolved solids (TDS) after drainage of water from a pulp mat in the presence of the copolymer as compared to the drainage rate of water from a pulp mat in the absence of the copolymer.

Pulp Mixture:

The pulp mixture may be alternatively described as a pulp slurry. The pulp mixture includes the lignocellulosic material. The lignocellulosic material may be any known in the art. The lignocellulosic material may be described as a lignocellulosic fibrous material prepared by chemically or mechanically separating cellulose fibers from a source of fiber, such as wood, paper, etc. The lignocellulosic material may be, or may be based on, virgin pulp, deinked pulp (DIP), unbleached Kraft pulp (UBK), mechanical pulps like thermal mechanical pulp (TMP), semi-chemical mechanical pulps like neutral sulfite semi-chemical (NSSC), old corrugated containers (OCC), recovered newspaper, recovered tissue or other fiber sources. Typically, the lignocellulosic material is present in the pulp mixture in an amount of from about 0.5 to about 20, about 1 to about 19, about 2 to about 18, about 3 to about 17, about 4 to about 16, about 5 to about 15, or about 6 to about 14, about 7 to about 13, about 8 to about 12, about 9 to about 11, or about 10 to about 11, weight percent based on a total weight of the pulp mixture. In various embodiments, all values and ranges of values including and between those set forth above are hereby expressly contemplated for use herein.

The pulp mixture may have any fiber consistency. In various embodiments, the fiber consistency is about 0.5%, 1%, or 2% or higher, e.g. from about 2 to about 3, about 3 to about 4, about 2 to about 4, or about 4, %. Typically, the water is present in the pulp mixture in an amount of at least about 80, 85, 90, 95, etc. weight percent based on a total weight of the pulp mixture. In other embodiments, the water is present in about 90, 91, 92, 93, 94, 95, 96, 97, 98, 99, or almost 100, weight percent based on a total weight of the pulp mixture. In various embodiments, all values and ranges of values including and between those set forth above are hereby expressly contemplated for use herein.

The lignin itself is present in an amount of greater than about 150 ppm, based on a total weight of the pulp mixture. In various embodiments, the lignin is present in an amount of up to about 25,000, 50,000, 75,000, or 100,000 ppm, based on a total weight of the pulp mixture. In other embodiments, the lignin is present in an amount of about 200 to about 4000, about 500 to about 3500, about 1000 to about 3000, about 1500 to about 2500, or about 2000 to about 2500, ppm, based on a total weight of the pulp mixture. In other embodiments, the amount of lignin is about 200 to about 1000, about 300 to about 900, about 400 to about 800, about 500 to about 700, or about 600 to about 700, ppm, based on a total weight of the pulp mixture. In various embodiments, all values and ranges of values including and between those set forth above are hereby expressly contemplated for use herein.

The inorganic salt is not particularly limited and may be any known in the art. For example, the inorganic salt may be NaOH, $Na_2S$, $Na_2CO_3$, $Na_2SO_3$, $Na_2SO_4$, $Na_2S_2O_3$, and the like, as appreciated by those of skill in the art, or combinations thereof. The approximate highest concentration of inorganic salts are found in black liquor. In various embodiments, the concentrations of various inorganic salts are: NaOH at about 5 to about 10 wt %, $Na_2S$ at about 15 to about 25 wt %, $Na_2CO_3$ at about 35 to about 40 wt %, $Na_2SO_3$ at about 5 to about 10%, $Na_2SO_4$ at about 10 to about 15%, and $Na_2S_2O_3$ at about 15 to about 20 wt %, each based on a total weight of the pulp mixture. In varying embodiments, one or more of these salts may be present in an amount of about 0.1, 0.5, 1, 2, 3, 4, 5, 6, 7, 8, 9, 10, etc. up to about 40, wt %, based on a total weight of the pulp mixture. The total residual of these inorganic salts are typically less than 3 wt %. In various embodiments, all values and ranges of values including and between those set forth above are hereby expressly contemplated for use herein.

The pulp mixture may also include inorganic minerals and organic extractives such as fatty and resin acids, dissolved organic compounds including cellulosic and hemicellulosic sugars/oligomers, fatty acid and resin acid soaps, and combinations thereof. These compounds are also not particularly limited and may be any known in the art. Moreover, they may be present in any typical amounts as is known in the art. In various embodiments, the organic extractives are present in an amount of from about 1 to about 10 weight percent based on a total weight of the pulp mixture. In various embodiments, this disclosure targets removal of fatty acids and their soaps and resin acids.

Reduction of the extractives and the inorganic salts remaining in the pulp mixture after washing is an indication of improved cleanliness. These are considered contaminants in a bleach plant resulting in increased bleaching costs, lower production rates or even downtime to clean up. Dirt in the sheets leads to poor quality paper. Moreover, these contaminants can lead to fouling of equipment. Cleanliness can be achieved with increased dewatering and better washing.

The pulp mixture also includes the copolymer including one or more structural units chosen from ethylene oxide units, propylene oxide units, (meth)acrylic acid units, ethyl acrylate units, and combinations thereof. Ethylene oxide (E/O) and propylene oxide (P/O) units are known in the art.

The terminology "(meth)acrylic acid units" describes both methacrylic acid units, i.e., acrylic acid units that include the methyl group, and also acrylic acid units that are free of the methyl group. In other words, the parenthetical "(meth)" terminology indicates that the methyl group is optional and either may or may not be included in the definition of the acrylic acid units.

Moreover, the copolymer is free of silicone-containing structural units. In other words, the copolymer is not a silicone copolymer and does not include any "Si" atoms or units. Moreover, the pulp mixture itself may be free of any additional silicone polymers or copolymers independent from the aforementioned copolymer. Alternatively, the pulp mixture may be substantially free of silicone polymers or copolymers, e.g. including less than 5, 4, 3, 2, 1, 0.5, or 0.1, weight percent of the silicone polymers or copolymers, based on a total weight of the pulp mixture. In various embodiments, all values and ranges of values including and between those set forth above are hereby expressly contemplated for use herein.

Examples of silicone polymers or copolymers that are typically excluded include any one or more of those set forth in the Examples below or the Momentive Silwet L7200 series, Wacker Pulpsil 900S series, and/or the Dow Corning 5000 series. Typical compounds are shown below. Moreover, in various embodiments, the pulp mixture is free of Rake, Pendant, and/or ABA type silicone copolymers.

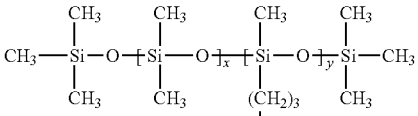

Silicone Polyether SPE Surfactant — Rake type SPE

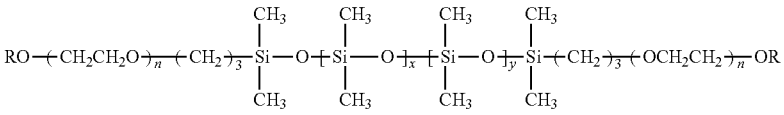

Silicone Polyether SPE Surfactant — ABA type SPE

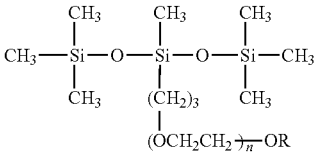

Silicone Polyether SPE Surfactant — Trisiloxane type SPE

Referring back to the copolymer itself of this disclosure, the copolymer may include one or more structural units chosen from ethylene oxide units, propylene oxide units, and a combination thereof. For example, the copolymer may be a linear copolymer and include ethylene oxide units and propylene oxide units. In one embodiment, the copolymer has a structure according to formula (I),

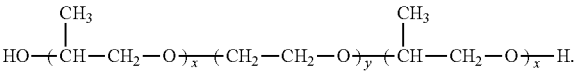

(I)

In this formula (I), each of x and y, independently of each other, have a value of from about 1 to about 200. In various embodiments, x is independently from about 5 to about 40, about 5 to about 35, about 5 to about 30, about 10 to about 25, about 15 to about 20, 5, 10, 15, 20, 25, 30, 35, 40, etc. In other embodiments, y is independently from 5 about to about 40, about 5 to about 35, about 5 to about 30, about 10 to about 25, about 15 to about 20, 5, 10, 15, 20, 25, 30, 35, 40, etc. In other embodiments, the ratio of x:y is from about 10:1 to about 1:10, e.g. about 9:1, about 8:1, about 7:1, about 6:1, about 5:1, about 4:1, about 3:1, about 2:1, about 1:1, about 1:2, about 1:3, about 1:4, about 1:5, about 1:6, about 1:7, about 1:8, or about 1:9, or any range therebetween. In various embodiments, all values and ranges of values including and between those set forth above are hereby expressly contemplated for use herein.

In other embodiments, the copolymer is a branched copolymer and includes ethylene oxide units and propylene oxide units. For example, the copolymer may have a core and two or more chains extending from the core which forms the branching of the branched copolymer. The core itself may be any known in the art. For example, the core may be derived from a hydroxy-containing compound including, but not limited to, hydroxy-containing compounds chosen from sorbitan, glycerol, erythritol, and combinations thereof. In various embodiments, the two or more chains independently include ethylene oxide units and/or propylene oxide units. In one embodiment, the copolymer has a structure according to formula (II), (II)

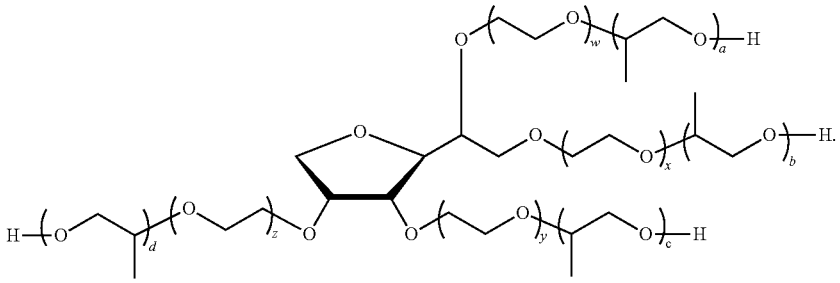

In this formula (II), each of a, b, c, d, w, x, y, and z, independently of each other, have a value of from about 1 to about 200. In various embodiments, the value of each of w, x, y, and z is independently about 5 to about 50. In other embodiments, the value of each of w, x, y, and z is independently about 10 to about 30. In further embodiments, the value of each of w, x, y, and z is independently about 12 to about 24. In still further embodiments, the value of each of a, b, c, and d is about 7 to about 70. In other embodiments, the value of each of a, b, c, and d is about 12 to about 40. In further embodiments, the value of each of a, b, c, and d is about 14 to about 28. In various embodiments, all values and ranges of values including and between those set forth above are hereby expressly contemplated for use herein.

Moreover, the ratio of w:a, the ratio of x:b, the ratio of y:c, and the ratio of z:d, independently of each other, are each from about 10:1 to about 1:10. In various embodiments, one or more of these ratios is independently about 9:1, about 8:1, about 7:1, about 6:1, about 5:1, about 4:1, about 3:1, about 2:1, about 1:1, about 1:2, about 1:3, about 1:4, about 1:5, about 1:6, about 1:7, about 1:8, or about 1:9, or any range therebetween. In various embodiments, all values and ranges of values including and between those set forth above are hereby expressly contemplated for use herein. In various embodiments, all values and ranges of values including and between those set forth above are hereby expressly contemplated for use herein.

In still other embodiments, the copolymer includes one or more structural units chosen from (meth)acrylic acid units, ethyl acrylate units, and a combination thereof. Just as above, the terminology "(meth) acrylic acid units" describes both methacrylic acid units, i.e., acrylic acid units that include the methyl group, and also acrylic acid units that are free of the methyl group. In other words, the parenthetical "(meth)" terminology indicates that the methyl group is optional. In various embodiments, the copolymer is a random copolymer that includes the units described immediately below relative to "x" and "y" subscripts. Alternatively, the copolymer may be described as a blocky type of copolymer, as would be appreciated by one of skill in the art.

In various embodiments, the copolymer has a structure according to formula (III), (III)

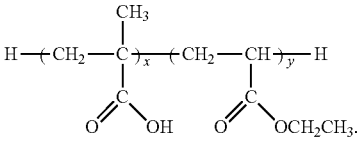

In this formula (III), each of x and y, independently of each other, have a value of from about 1 to about 200. In other embodiments, the value of each of x and y is independently any number or range of numbers including and between 1 and 200. Moreover, the ratio of x:y is from about 10:1 to about 1:10. In various embodiments, this ratio is about 9:1, about 8:1, about 7:1, about 6:1, about 5:1, about 4:1, about 3:1, about 2:1, about 1:1, about 1:2, about 1:3, about 1:4, about 1:5, about 1:6, about 1:7, about 1:8, or about 1:9, or any range therebetween. In various embodiments, all values and ranges of values including and between those set forth above are hereby expressly contemplated for use herein.

The copolymer is not particularly limited based on amount included in the pulp mixture. However, in one embodiment, the copolymer is present in an amount of from about 0.10 to about 3.0 pounds of actives per US ton of oven dry pulp. In other embodiments, this amount is from about 0.1 to about 1, about 0.1 to about 0.5, about 0.5 to about 1, or about 0.1, 0.2, 0.3, 0.4, 0.5, 0.6, 0.7, 0.8, 0.9, or 1, pounds of actives per US ton of oven dry pulp. In various embodiments, all values and ranges of values including and between those set forth above are hereby expressly contemplated for use herein.

In one embodiment, the lignocellulosic material is present in an amount of from about 0.5 to about 20 weight percent based on a total weight of the pulp mixture, the water is present in an amount of at least about 75 weight percent based on a total weight of the pulp mixture, the inorganic salt is present in an amount of less than about 6 weight percent in pure black liquor in brownstock emerging from a digester based on the total weight of the pulp slurry, less than about 3 weight percent in washed brownstock, less than about 3 weight percent in unwashed bleached stock, and less then about 2 percent in unwashed extraction stage bleached stock per US ton of oven dry pulp.

Method of Improving Drainage Rate During Pulp Washing:

This disclosure also provides a method for improving drainage rate during pulp washing. The method includes the steps of providing the pulp mixture. The step of providing is not particularly limited and may be alternatively described as supplying or otherwise making the pulp mixture and the copolymer available for use in the method.

The method further includes the steps of forming a pulp mat from the pulp mixture and draining the water from the pulp mat. In this step, the pulp mat exhibits an increase in drainage rate of the water in the presence of the copolymer as compared to a pulp mat that is drained in the absence of the copolymer, as first introduced above. The step of draining may also be further defined as any step of draining known in the art. In one embodiment, the step of draining the water is performed in a brown stock washing process, a bleach plant process, a market pulp machine process, or combinations thereof.

In various embodiments of the method, the pulp mixture exhibits an increase in drainage rate of the water in the presence of the copolymer as compared to a pulp mixture that is drained in the absence the copolymer. For example, the pulp mixture may exhibit an increase of at least about 5%, about 10%, about 15%, about 20%, about 25%, about 30%, about 35%, about 40%, about 45%, about 50%, about 55%, about 60%, about 65%, about 70%, about 75%, etc. in drainage rate of water from a pulp mat in the presence of the copolymer as compared to the drainage rate of water from a pulp mat in the absence of the copolymer. These rates may fluctuate, for example, when measured relative to brown-stock drainage or bleached pulp extraction stage drainage.

Method of Improving Dewatering Rate:

This disclosure also provides a method for improving dewatering rate. The method includes the steps of providing the pulp mixture. The step of providing is not particularly limited and may be alternatively described as supplying or otherwise making the pulp mixture and the copolymer available for use in the method.

The method further includes the steps of forming a pulp mat from the pulp mixture and dewatering the pulp mat. In this step, the pulp mat exhibits an increase in dewatering rate of the pulp mat in the presence of the copolymer as compared to a pulp mat that is dewatered in the absence of the copolymer, as first introduced above. In various embodiments, the pulp mixture exhibits an increase of at least about 5%, about 10%, about 15%, about 20%, about 25%, about 30%, about 35%, about 40%, about 45%, about 50%, about 55%, about 60%, about 65%, about 70%, about 75%, etc. in dewatering rate as defined as an amount of water passing through a pulp mat in the presence of the copolymer per unit washing time as compared to an amount of water passing through a pulp mat in the absence of the copolymer per unit washing time.

Method of Improving Removal of Inorganic Salts:

This disclosure also provides a method for improving removal of inorganic salts from the pulp mixture. The method includes the steps of providing the pulp mixture. The step of providing is not particularly limited and may be alternatively described as supplying or otherwise making the pulp mixture and the copolymer available for use in the method.

The method further includes the steps of forming a pulp mat from the pulp mixture and draining water from the pulp mat. The step of draining may also be further defined as any step of draining known in the art. In one embodiment, the step of draining the water is performed in a brown stock washing process, a bleach plant process, a market pulp machine process, or combinations thereof. In this method, the removal of the inorganic salts is measured after drainage of water from a pulp mat in the presence of the copolymer as compared to the drainage of water from a pulp mat in the absence of the copolymer. In further embodiments, the pulp mixture that includes the inorganic salt exhibits a decrease in an amount of the inorganic salt of at least about 5%, about 10%, about 15%, about 20%, about 25%, about 30%, about 35%, about 40%, about 45%, etc. based on mass balance calculations and as measured by total dissolved solids (TDS) after drainage of water from a pulp mat in the presence of the copolymer as compared to drainage of water from a pulp mat in the absence of the copolymer.

EXAMPLES

The Examples set forth below investigate drainage performance utilizing a custom designed apparatus that allows dirty pulp slurries to be dewatered under controlled vacuum conditions at hot process temperatures. An experimental protocol is set forth below wherein output is a simple measurement of effluent mass collected through a screen over measured time intervals. The time vs mass effluent collected data can be graphed to display a drainage curve, or the mass collected at a specific time (e.g. 15 to 25 seconds) can be compared directly for different copolymers or comparative examples.

Example 1

Unbleached maple kraft brownstock at 3% solids along with unbleached southern oak and poplar mix are drained in the test apparatus. 125 mL of black liquor effluent is drained after treatment with 4 lb actives of various copolymers/ton US OD pulp, as set forth below. The treated pulps are compared to untreated samples drained to remove the same amount of effluent.

More specifically, Copolymers 1-3 are evaluated and are identified as follows: Each of Copolymers 1-3 is an EO/PO block copolymer having the following general formula according to formula (II) below:

(II)

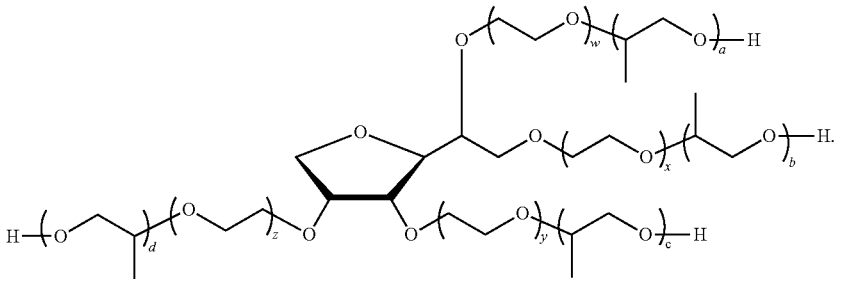

Relative to Copolymer 1, each w, x, y, z is about 6 and a, b, c, d is about 36.

Relative to Copolymer 2, each x is about 20 and y is about 24.

Relative to Copolymer 3, each x is about 10 and y is about 12.

Figure 2:
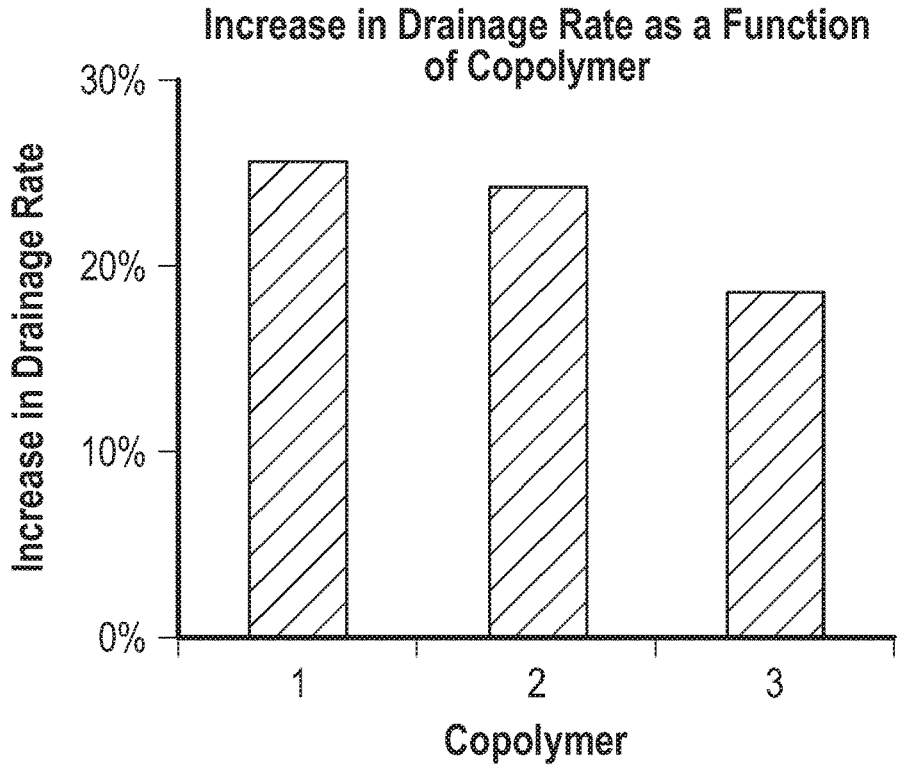
FIG. 2 is a second bar graph of increase in drainage rate as a function of choice of copolymer, as also described in Example 1.

The data shows that treated samples drain faster resulting in a shorter elapsed time to reach 125 mL of effluent black liquor collected. The time savings is converted to % difference for comparison. Drainage rates are significantly improved with treatment by the copolymers. These results are set forth in FIGS. 1 and 2 wherein FIG. 1 includes the data related to the unbleached maple kraft brownstock at 3% solids and FIG. 2 includes the data related to the unbleached southern oak and poplar mix.

Example 2

Unbleached Northern European birch kraft brownstock is evaluated. Silicone free compositions containing various copolymers are trialed against a silicone based defoamer containing a silicone polyether surfactant (SPE) drainage aid and a silicone free product that is commercially available from BIM Kemi AB. These compounds are utilized at a dosage of 500 g/MT OD pulp to a 3% pulp slurry before drainage.

More specifically, (Co)Polymers 4-8 are evaluated and are identified as follows:

Polymer 4 is a silicon emulsion defoamer that includes a silicone polyether surfactant (SPE) drainage aid that is commercially available from Solenis under the tradename of Advantage BN3397.

Copolymer 5 is a 2% actives solution of Copolymer 2 in water.

Copolymer 6 is a 10% actives solution of Copolymer 2 in water.

Copolymer 7 is a 10% actives solution of Copolymer 2 in water.

Polymer 8 is a silicone emulsion defoamer that is commercially available from BIM Kemi AB under the tradename of AF4442.

Figures 3, 4:
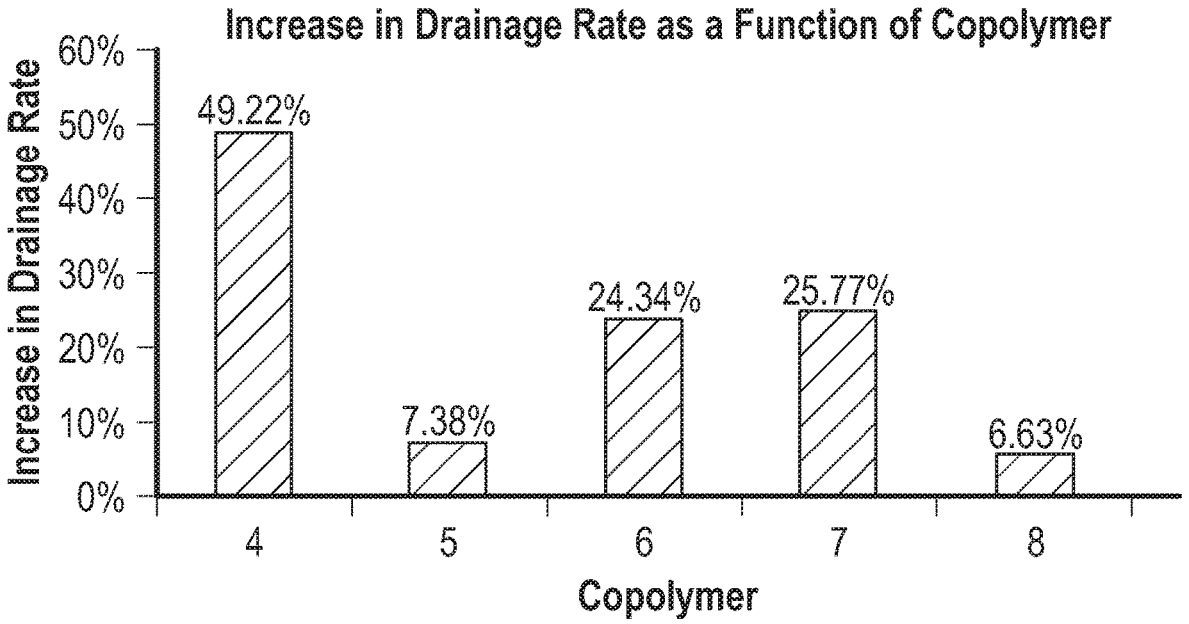
FIG. 3 is a bar graph of increase in drainage rate as a function of choice of copolymer, as described in Example 2.
FIG. 4 is a table of volume of filtrate collected per unit time and copolymer, as described in Example 3.

The data set forth in FIG. 3 shows that drainage rates are significantly improved with treatment by the copolymers as compared to the Copolymer 8.

Example 3

Unbleached eucalyptus kraft brownstock is evaluated with mill pulp produced immediately before testing. A 3% pulp slurry is drained in the test apparatus to 8-10% solids to form a pad. Subsequently, clean hot water is displaced through the pad to simulate washing. Various copolymers are added at 1 lb as actives/ton OD pulp and evaluated at process temperature.

More specifically, (Co)Polymers 9-11 are evaluated and are identified as follows:

Polymer 9 is a silicone polyether surfactant that is commercially available from Momentive under the tradename of Silwet DA-40.

Polymer 10 is a silicone polyether surfactant that is commercially available from Momentive under the tradename of Silwet DA-33.

Copolymer 11 has the same identity as Copolymer 2 above.

Figure 5:
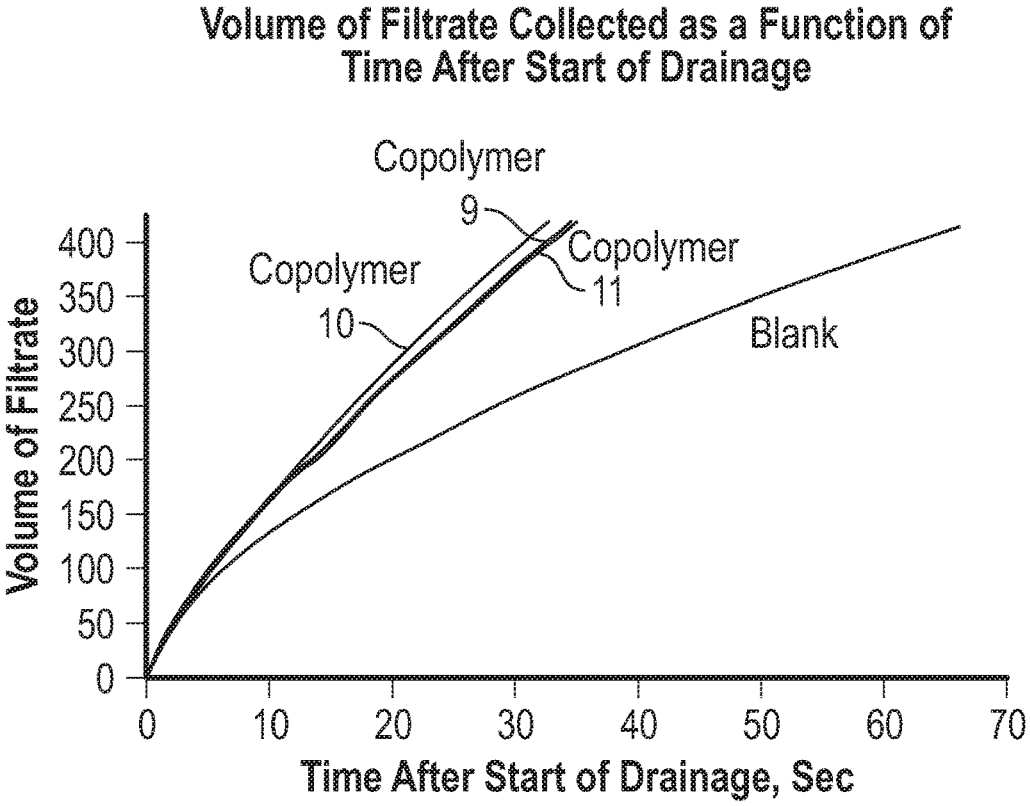
FIG. 5 is a line graph of the volume of filtrate collected as a function of time after start of drainage, as described in Example 3.

The data in the Table of FIG. 4 and the line graph of FIG. 5 shows that the volume of filtrate collected per unit time is significantly larger for the treated pulps. This data also shows that the non-silicone EO/PO block copolymers of this disclosure perform similarly to the best silicone polyether surfactants (SPEs) used in this example.

Example 4

Unbleached northern pine/hemlock mix kraft brownstock along with pine/fir mix kraft brownstock are drained in the test apparatus. 125 mL of black liquor effluent is drained after treatment with 4 lb actives of various copolymers/ton US OD pulp. The treated pulps are compared to untreated samples drained to remove the same amount of effluent.

More specifically, Copolymers 12-14 are evaluated and are identified as follows:

Copolymer 12 has the same identity as Copolymer 1 above.

Copolymer 13 has the same identity as Copolymer 2 above.

Copolymer 14 has the same identity as Copolymer 3 above.

Figure 6:
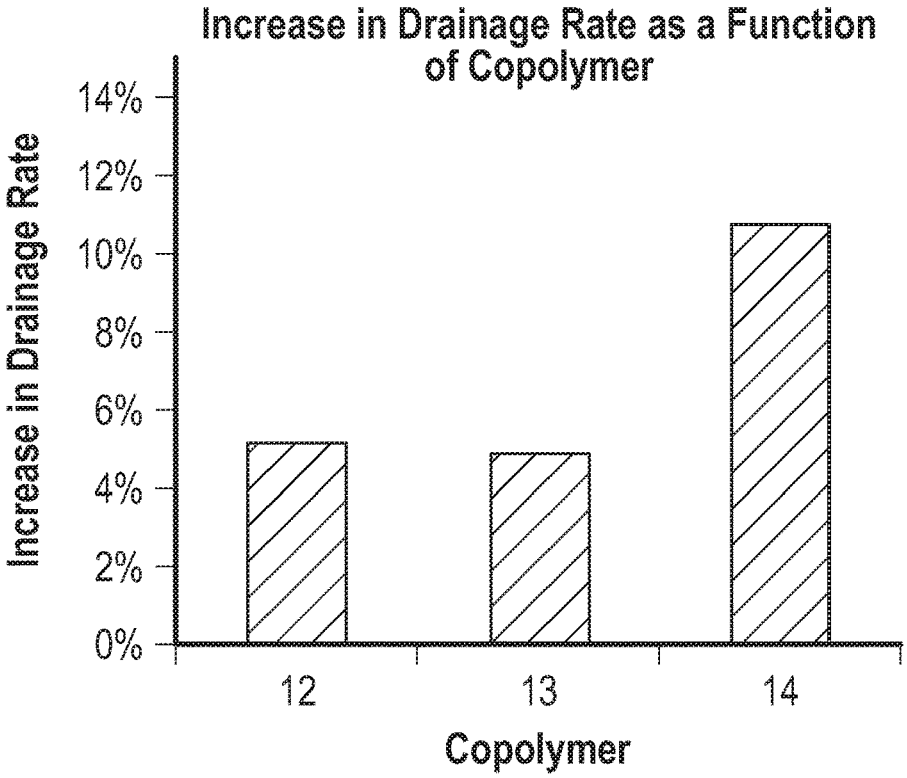
FIG. 6 is a bar graph of increase in drainage rate as a function of choice of copolymer, as described in Example 4.
Figure 7:
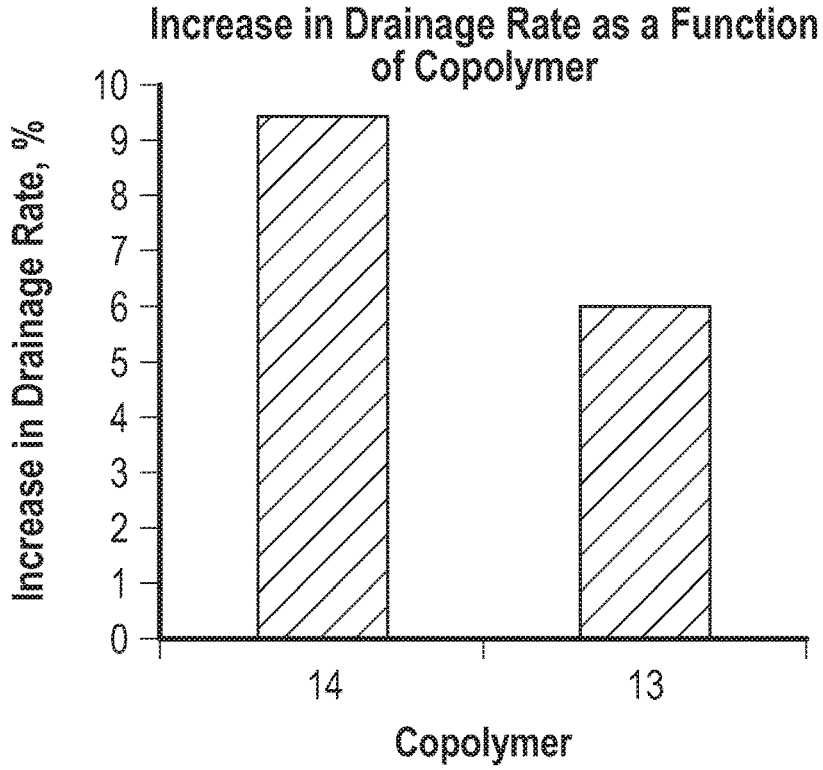
FIG. 7 is a second bar graph of increase in drainage rate as a function of choice of copolymer, as also described in Example 4.

The data shows that treated samples drained faster resulting in a shorter elapsed time to reach 125 mL of effluent black liquor collected. The time savings is converted to % difference for comparison, as shown in FIGS. 6 and 7 wherein FIG. 6 includes the data related to the unbleached northern pine/hemlock mix kraft brownstock and FIG. 7 includes the data related to the pine/fir mix kraft brownstock. Drainage rates are improved with treatment by the copolymers of this disclosure.

Example 5

Bleached Northern hardwood kraft pulp from an extraction stage washing is simulated with pulp and effluent. A 3% pulp slurry is drained for a 25 second interval after treatment with various copolymers, and compared to untreated pulp.

More specifically, Copolymers 15-19 are evaluated and are identified as follows:

Copolymer 15 an EO/PO block copolymer commercially available from Vantage Performance Materials under the trade name of Lumulse 1061L.

Copolymer 16 is an acrylate-based emulsion copolymer having the following general formula according to formula (III):

(III)

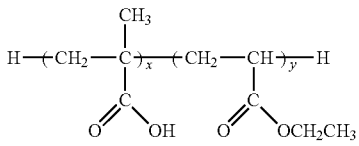

wherein, x is about 1 and y is about 1.

Copolymer 17 is an EO/PO block copolymer having the following general formula according to formula (I) above:

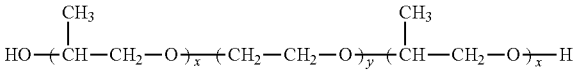

wherein, each x is about 25 and y is about 8.

Copolymer 18 has the same identity as Copolymer 2 above.

Copolymer 19 is an EO/PO block copolymer having the following general formula according to formula (I) above:

(I)

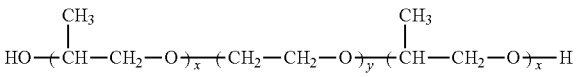

wherein, each x is about 20 and y is about 35.

Figure 8:
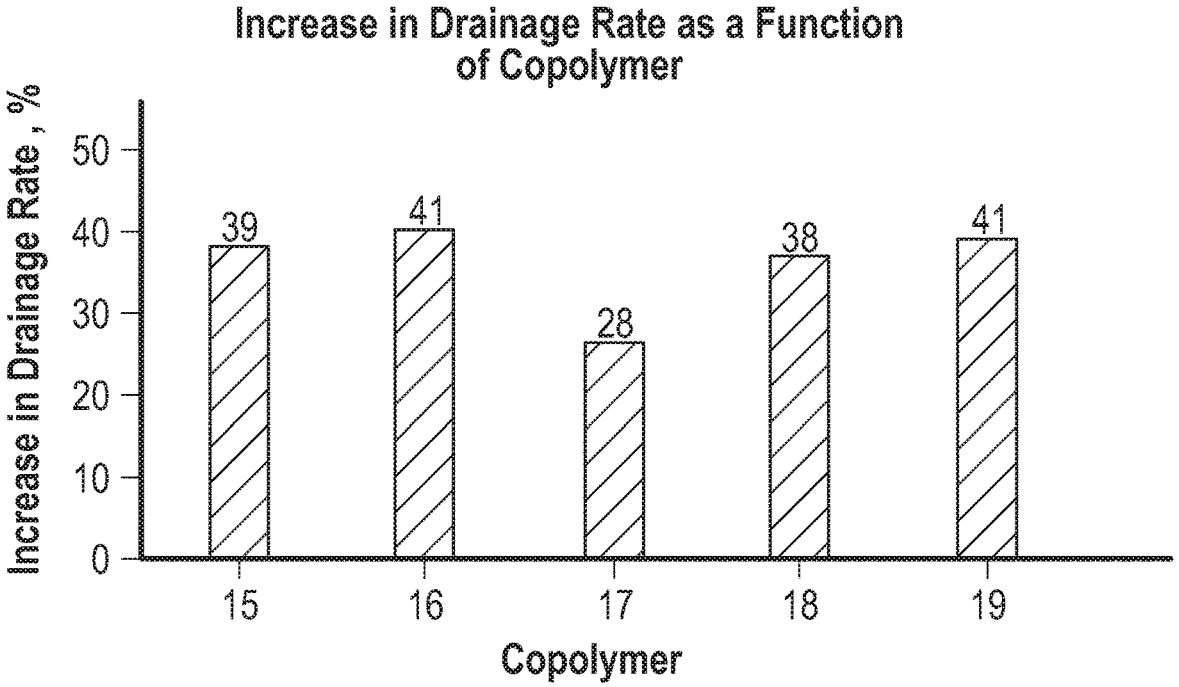
FIG. 8 is a bar graph of increase in drainage rate as a function of choice of copolymer, as described in Example 5.

The data shows that the amount of effluent removed is significantly greater for the treated samples, as shown in FIG. 8. The use of an EO/PO block copolymer of this disclosure improves drainage rate about 30 to about 40%, while the use of a methacrylic acid ethyl acrylate copolymer of this disclosure provides an about 40% improvement. This is significant because it introduces a new functional chemistry (i.e., an anionically charged acrylate polymer in an alkaline medium) that performs well in this application and has a favorable regulatory clearance (FDA indirect food contact).

Figure 9:
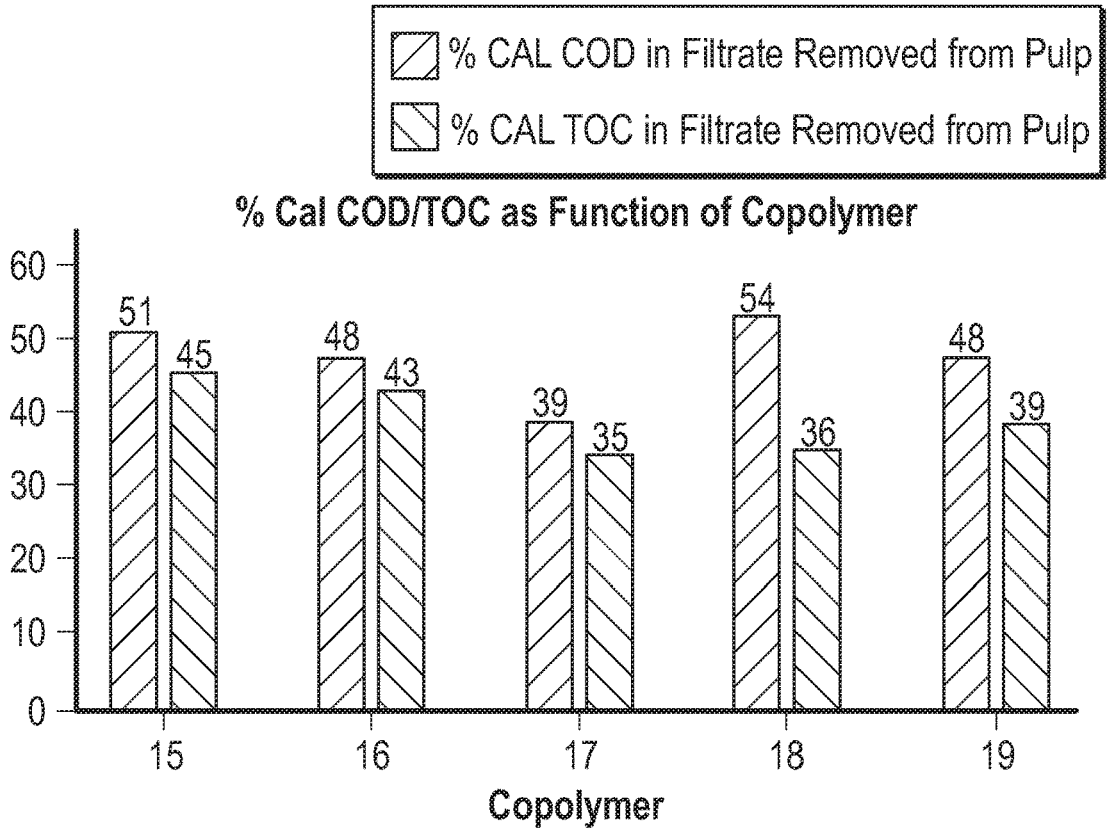
FIG. 9 is a bar graph of percent calculated chemical oxidant demand (COD) in filtrate removed from pulp and percent calculated total organic carbon (TOC) in filtrate removed from pulp as a function of choice of copolymer, as also described in Example 5.

The pulp is also compared as to the cleanliness after the 25 second drainage interval. The faster draining pulp contained less dirty effluent, and showed significant chemical oxidant demand (calculated COD) and total organic carbon (calculated TOC) reduction, as set forth in FIG. 9.

Example 6

Figure 10:
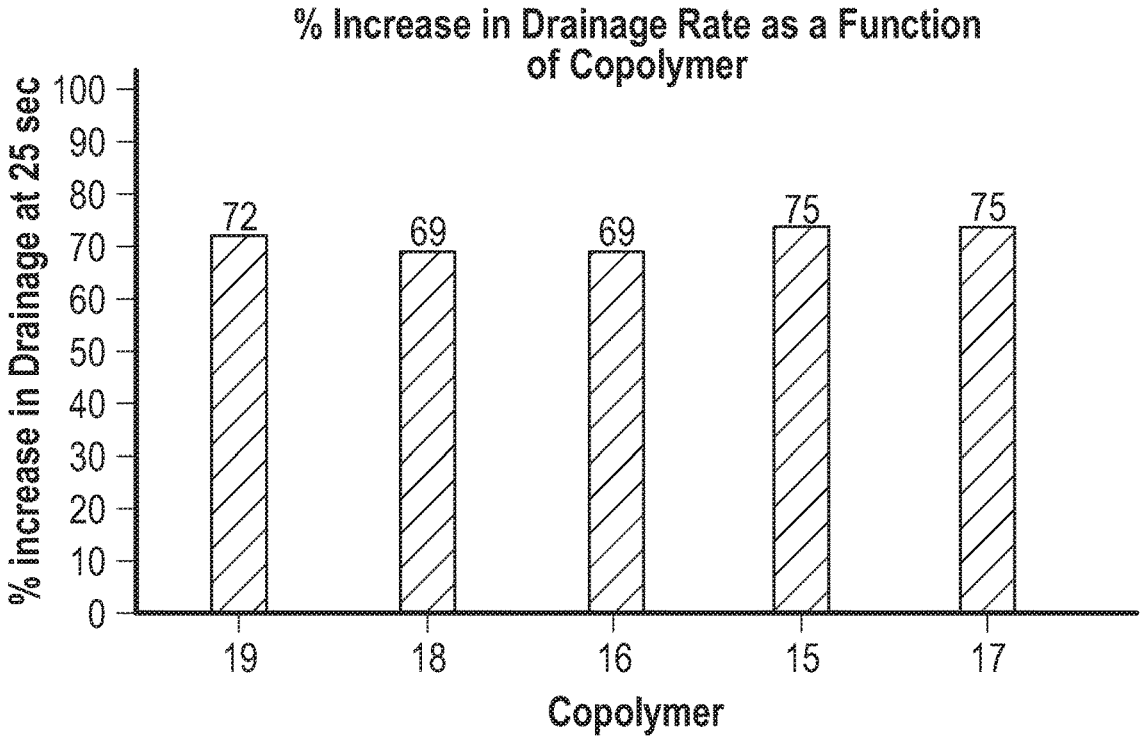
FIG. 10 is a bar graph of increase in drainage rate as a function of choice of copolymer, as described in Example 6.

Unbleached Southern hardwood kraft pulp brownstock is collected before bleaching at 1% solids (before being thickened to >10%). A 3% slurry is drained for 25 seconds after treatment with various copolymers at 3 lb actives of various copolymers/ton US pulp, and compared to untreated pulp. More specifically, Copolymers 15-19 are again evaluated. The data shows that EO/PO block copolymers improved drainage rate by about 70 to about 75% in this application, as shown in FIG. 10.

Example 7

Figure 11:
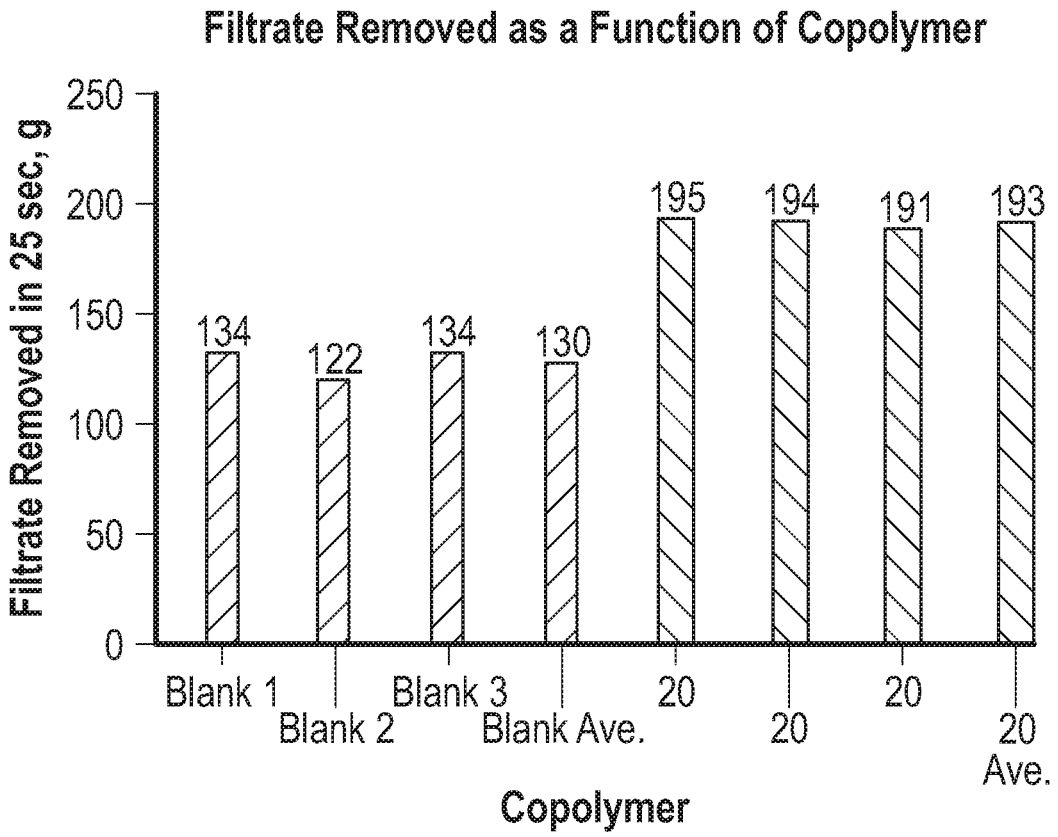
FIG. 11 is a bar graph of filtrate removed as a function of choice of copolymer, as described in Example 7.

Bleached Southern hardwood kraft pulp is collected from an alkaline extraction stage with filtrate. A 3% pulp slurry is drained for a 25 second interval after treatment with 3 lb/ton US of an EO/PO block copolymer and compared to untreated pulp. More specifically, Copolymer 20 is evaluated. Copolymer 20 has the same identity as Copolymer 19. The mass of filtrate is removed and measured and the experiment is repeated 3 times each with the blank and treatment to demonstrate repeatability. The data shows that a larger amount of effluent is removed from the treated pulp which represents an about 48% increase in drainage, as shown in FIG. 11.

CONCLUSIONS REGARDING DATA

This data shows that the pulp mixture and method improves the rate pulp can be drained in the washing operation. This can result in a cleaner pulp at a fixed time interval, or a higher throughput of pulp (increased production rate). A balance of these two benefits can also be realized.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A pulp mixture comprising:

a lignocellulosic material;

water;

lignin;

an inorganic salt; and a copolymer comprising two or more structural units chosen from ethylene oxide units, propylene oxide units, (meth)acrylic acid units, ethyl acrylate units, and combinations thereof;

wherein said copolymer is free of silicone-containing structural units, and wherein said lignin is present in an amount of greater than about 150 ppm, based on a total weight of said pulp mixture.

2. The pulp mixture of claim 1, wherein said copolymer comprises ethylene oxide units and propylene oxide units.

3. The pulp mixture of claim 2, wherein said copolymer is a linear copolymer.

4. The pulp mixture of claim 2, wherein said copolymer is a branched copolymer.

5. The pulp mixture of claim 1, wherein said copolymer has a structure according to formula (I), (I)

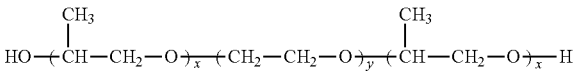

wherein:

x and y, independently of each other, have a value of from about 1 to about 200; and a ratio of x:y is from about 10:1 to about 1:10.

6. The pulp mixture of claim 5, wherein each x is from about 10 to about 30 and y is from about 20 to about 40.

7. The pulp mixture of claim 1, wherein said copolymer has a core and two or more chains extending from said core, wherein said core is derived from a hydroxy-containing compound, and each of said two or more chains independently comprise ethylene oxide units and propylene oxide units.

8. The pulp mixture of claim 7, wherein said hydroxy-containing compound is chosen from sorbitan, glycerol, erythritol, and combinations thereof.

9. The pulp mixture of claim 8, wherein said copolymer has a structure according to formula (II), (II)

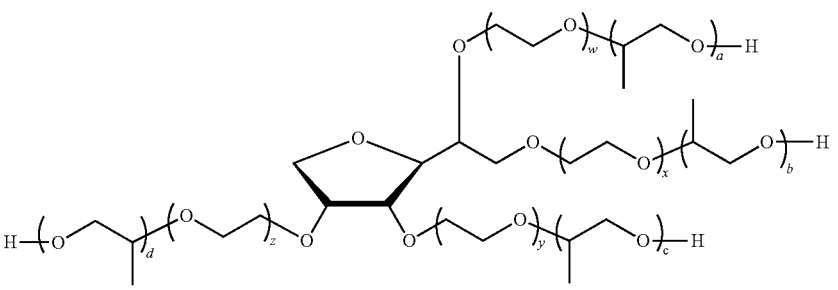

wherein:

a, b, c, d, w, x, y, and z, independently of each other, have a value of from about 1 to about 200; and a ratio of w:a, a ratio of x:b, a ratio of y:c, and a ratio of z:d, independently of each other, are each from about 10:1 to about 1:10.

10. The pulp mixture of claim 9 wherein each of a, b, c, and d is independently about 7 to about 70 and each of w, x, y, and z is independently about 5 to about 50.

11. The pulp mixture of claim 1, wherein said copolymer comprises (meth)acrylic acid units and ethyl acrylate units.

12. The pulp mixture of claim 11, wherein said copolymer has a structure according to formula (III), (III)

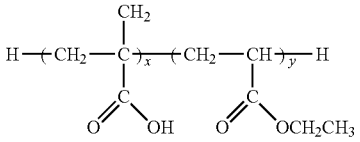

wherein:

x and y, independently of each other, have a value of from about 1 to about 200; and a ratio of x:y is from about 10:1 to about 1:10.

13. The pulp mixture of claim 1, wherein said copolymer is present in an amount of from about 0.10 to about 3.0 pounds of actives per US ton of oven dry pulp.

14. The pulp mixture of claim 1 that exhibits an increase of at least about 5% in drainage rate of water from a pulp mat in the presence of said copolymer as compared to drainage rate of water from an identical pulp mat under identical conditions but in the absence of said copolymer.

15. The pulp mixture of claim 1 that exhibits an increase of at least about 5% in dewatering rate as defined as an amount of water passing through a pulp mat in the presence of said copolymer per unit washing time as compared to an amount of water passing through an identical pulp mat under identical conditions but in the absence of said copolymer per unit washing time.

16. The pulp mixture of claim 1 that exhibits a decrease in the amount of the inorganic salt of at least 5 wt % measured after drainage of water from a pulp mat in the presence of said copolymer as compared to drainage of water from an identical pulp mat under identical conditions but in the absence of said copolymer.

17. The pulp mixture of claim 1 wherein said lignocellulosic material is present in an amount of from about 0.5 to about 20 weight percent based on a total weight of said pulp mixture, said water is present in an amount of at least about 75 weight percent based on a total weight of said pulp mixture, said inorganic salt is present in an amount of less than about 6 weight percent based on a total weight of said pulp mixture, and said copolymer is present in an amount of from about 0.10 to about 1.0 pounds of actives per US ton of oven dry pulp.

18. A method for improving drainage during pulp washing, the method comprising:

providing a pulp mixture comprising a lignocellulosic material, water, lignin, an inorganic salt, and a copolymer comprising two or more structural units chosen from ethylene oxide units, propylene oxide units, (meth)acrylic acid units, ethyl acrylate units, and combinations thereof, wherein the copolymer is free of silicone-containing structural units, and the lignin is present in an amount of greater than about 150 ppm, based on a total weight of the pulp mixture;

forming a pulp mat from the pulp mixture; and draining the water from the pulp mat;

wherein the pulp mixture exhibits an increase of at least about 5% in drainage rate of the water from the pulp mat in the presence of the copolymer as compared to drainage rate of water from a pulp mat under identical conditions but in the absence of the copolymer.

19. The method of claim 18, wherein the step of draining the water is performed in a brown stock washing process, a bleach plant process, a market pulp machine process, or combinations thereof.

20. The method of claim 19 wherein the copolymer has one of the following structures according to formulae (I), (II), or (III), wherein formula (I) is:

(I)

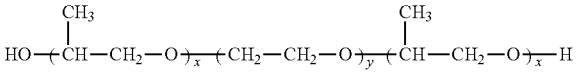

wherein:

x and y, independently of each other, have a value of from about 1 to about 200; and a ratio of x:y is from about 10:1 to about 1:10, wherein formula (II) is:

(II)

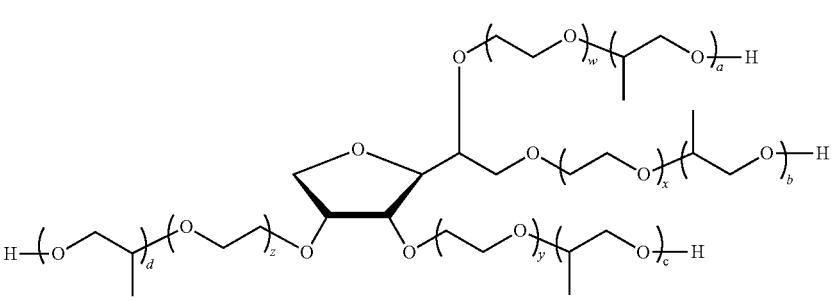

wherein:

a, b, c, d, w, x, y, and z, independently of each other, have a value of from about 1 to about 200; and a ratio of w:a, a ratio of x:b, a ratio of y:c, and a ratio of z:d, independently of each other, are each from about 10:1 to about 1:10, and wherein formula (III) is:

(III)

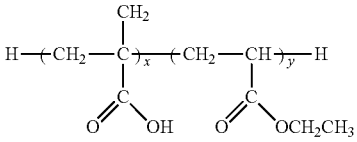

wherein:

x and y, independently of each other, have a value of from about 1 to about 200; and a ratio of x:y is from about 10:1 to about 1:10.

* * * * *